US006683035B1

(12) United States Patent
Koester et al.

(10) Patent No.: US 6,683,035 B1
(45) Date of Patent: Jan. 27, 2004

(54) GEL COMPOSITIONS CONTAINING ALKOXYLATED CARBOXYLIC ACID ESTERS, THEIR USE IN CLEANING TOILETS AND TOILET CLEANING PRODUCTS CONTAINING THE SAME

(75) Inventors: Rita Koester, Duesseldorf (DE); Ansgar Behler, Bottrop (DE); Jutta Stute, Cologne (DE); Ditmar Kischkel, Monheim (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 09/856,239

(22) PCT Filed: Nov. 9, 1999

(86) PCT No.: PCT/EP99/08569

§ 371 (c)(1),
(2), (4) Date: Aug. 27, 2001

(87) PCT Pub. No.: WO00/29532

PCT Pub. Date: May 25, 2000

(30) Foreign Application Priority Data

Nov. 18, 1998 (DE) ..... 198 53 110

(51) Int. Cl.[7] ..... C11D 1/74; C11D 3/22

(52) U.S. Cl. ..... 510/191; 510/192; 510/193; 510/289; 510/356; 510/370; 510/403; 510/421

(58) Field of Search ..... 510/191, 192, 510/193, 289, 356, 370, 403, 421

(56) References Cited

U.S. PATENT DOCUMENTS

| | | | | |
|---|---|---|---|---|
| 4,005,025 A | * | 1/1977 | Kinstedt | 252/89 R |
| 4,534,879 A | | 8/1985 | Iding et al. | |
| 4,820,449 A | | 4/1989 | Menke et al. | |
| 5,653,970 A | * | 8/1997 | Vermeer | 424/70.24 |
| 5,753,606 A | * | 5/1998 | Hees et al. | 510/422 |
| 5,877,135 A | | 3/1999 | Hahn | |
| 5,939,372 A | | 8/1999 | Schmid et al. | |
| 5,997,890 A | * | 12/1999 | Sine et al. | 424/401 |

FOREIGN PATENT DOCUMENTS

| | | | |
|---|---|---|---|
| CA | 2053900 | | 10/1990 |
| DE | 39 14 131 | A1 | 10/1990 |
| DE | 43 37 032 | C1 | 5/1995 |
| DE | 195 02 454 | A1 | 8/1996 |
| DE | 197 15 872 | A1 | 10/1998 |
| DE | 19715872 | * | 4/1999 |
| DE | 197 15 872 | C2 | 4/1999 |
| DE | 197 52 165 | A1 | 5/1999 |
| EP | 0 014 979 | B1 | 9/1980 |
| EP | 0 268 967 | A2 | 6/1988 |
| WO | WO90/13533 | A | 11/1990 |
| WO | WO95/04803 | A | 2/1995 |
| WO | WO97/04061 | A | 2/1997 |
| WO | WO00/02983 | A | 1/2000 |

* cited by examiner

*Primary Examiner*—Charles Boyer
(74) *Attorney, Agent, or Firm*—John E. Drach; Aaron R. Ettelman

(57) ABSTRACT

Gel compositions comprising a thickener and a surfactant component including an alkoxylated carboxylic acid ester corresponding to general formula (I):

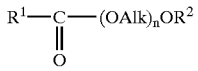

(I)

wherein $R^1C(O)$ represents an aliphatic acyl group, each AlkO independently represents an alkoxylate selected from the group consisting of $CH_2CH_2O$, $CHCH_3CH_2O$ and $CH_2CHCH_3O$, n is a number of from 1 to 20, and $R^2$ represents an aliphatic alkyl group, are described. The use of such gel compositions in methods of providing controlled release of cleaning agents to toilets is also described, in addition to the containers used in such methods.

25 Claims, No Drawings

GEL COMPOSITIONS CONTAINING ALKOXYLATED CARBOXYLIC ACID ESTERS, THEIR USE IN CLEANING TOILETS AND TOILET CLEANING PRODUCTS CONTAINING THE SAME

BACKGROUND OF THE INVENTION

For some time, flush toilets have been cleaned using solid toilet blocks which are either suspended in the cistern or fastened below the rim of the toilet bowl. Their function is to clean the surface of the toilet during the flushing process and, in particular, to mask unpleasant odors through the release of fragrances. In view in particular of their function to release fragrances, cleaners for flush toilets are also generally referred to in the literature as perfume blocks. Surfactants, builders, inorganic salts and, of course, fragrances and dyes are normally used for their production. Several such formulations are known from the prior art literature. U.S. Pat. No. 4,534,879 (Procter & Gamble), for example, describes solid cleaning compositions which contain as their surfactant component $C_{9-15}$ alkyl sulfates, alkyl benzenesulfonates and inorganic salts. EP-A 0 014 979 (Henkel) describes toilet blocks which contain alkyl benzenesulfonates and alkyl sulfates and also fatty alcohol or alkylphenol ethoxylates. DE-C2 43 370 32 (Henkel) relates to toilet blocks containing alkyl sulfates, alkyl ether sulfates and alkyl glucosides. EP-A 0 268 967 (Henkel) discloses toilet blocks containing sodium lauryl sulfate and fatty acid monoethanolamide.

The described toilet blocks are generally produced by casting, compression molding, extrusion or granulation processes which involve high outlay on machinery and, in many cases, suffer unwanted losses of perfume under the effect of the high temperatures prevailing (casting/extrusion processes).

Another disadvantage is that the refill units widely used on ecological grounds can only be used after the block has been exhausted. Although desirable, refilling as and when required, for example for a stronger release of active ingredients or, more particularly, for more intensive emission of perfume, is not possible.

German patent DE-C-197 15 872 describes gel-form toilet cleaners with pseudoplastic properties which significantly reduce production difficulties and which can be produced less expensively by virtue of the simple technology involved. The problem of individual refillability can also be solved by pseudoplastic formulations of the type in question. These known gel-form toilet cleaners contain polysaccharides, more particularly xanthan gum, for establishing their pseudoplastic properties and, as surfactants, alkyl polyglycosides (compulsory) and anionic and/or nonionic co-surfactants (optional). Fatty acid polyglycol esters in general are mentioned inter alia as nonionic surfactants.

Although these gel-form toilet cleaners are entirely satisfactory in regard to viscosity behavior and stability in storage, there is a need on the market for other gel-form toilet cleaners which combine high cleaning performance with good ecological compatibility.

The problem addressed by the present invention was to provide other gel-form toilet cleaners for flush toilets which would satisfy the demands made of them in regard to viscosity behavior, cleaning performance, stability in storage and ecological compatibility. In addition, the gel-form toilet cleaners for flush toilets would show very good initial foaming behavior and would be clear in appearance.

Furthermore, the various perfume oils would lend themselves to incorporation without difficulty, more particularly in quantities of at least 5% by weight.

BRIEF SUMMARY OF THE INVENTION

The present invention relates, in general, to gel-form cleaning compositions for flushing toilets, which cleaning compositions contain alkoxylated carboxylic acid esters, and more particularly, those esters which are obtained by the alkoxylation of carboxylic acid esters in the presence of calcined hydrotalcites as catalysts. The present invention also relates, in general to the use of such alkoxylated carboxylic acid esters and gel-form compositions in methods of cleaning flushing toilets and to the products containing these cleaning compositions.

Accordingly, the present invention relates to gel-form cleaning compositions for flush toilets containing thickeners and surfactants, characterized in that alkoxylated carboxylic acid esters corresponding to formula (I):

$$R^1\underset{\underset{O}{\|}}{C}(OAlk)_nOR^2 \qquad (I)$$

in which $R^1CO$ is an aliphatic acyl group, AlkO stands for $CH_2CH_2O$, $CHCH_3CH_2O$ and/or $CH_2CHCH_3O$, n is a number of 1 to 20 and $R^2$ is an aliphatic alkyl group, are present as surfactants.

DETAILED DESCRIPTION OF THE INVENTION

The compositions according to the invention compulsorily contain alkoxylated carboxylic acid esters corresponding to formula (I) as surfactants. Alkoxylated carboxylic acid esters are known from the prior art. They may be obtained, for example, by esterification of alkoxylated carboxylic acids with alcohols. For the purposes of the present invention, however, the compounds are preferably produced by reaction of carboxylic acid esters with alkylene oxides using catalysts, more especially calcined hydrotalcite in accordance with DE-A-39 14 131, which give compounds with a narrow homolog distribution. According to the invention, alkoxylated carboxylic acid esters corresponding to general formula (I), in which $R^1CO$ is an aliphatic acyl group containing 6 to 22 carbon atoms, AlkO stands for a $CH_2CH_2O$—, $CHCH_3CH_2O$— and/or $CH_2$—$CHCH_3O$ group, n has an average value of 3 to 20 and $R^2$ is an aliphatic alkyl group containing 1 to 22 carbon atoms, are preferred.

Preferred acyl groups are derived from carboxylic acids containing 6 to 22 carbon atoms of natural or synthetic origin, more especially from linear, saturated and/or unsaturated fatty acids, including the technical mixtures thereof obtainable by lipolysis from animal and/or vegetable fats and oils, for example from coconut oil, palm kernel oil, palm oil, soya oil, sunflower oil, rapeseed oil, cottonseed oil, fish oil, bovine tallow and lard. Examples of such carboxylic acids are caproic acid, caprylic acid, 2-ethyl hexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and/or erucic acid. More particularly, $R^1CO$ is a linear, even-numbered acyl group containing 8 to 18 carbon atoms.

Preferred alkyl groups $R^2$ are derived from primary, aliphatic monohydric alcohols containing 1 to 22 carbon atoms which may be saturated and/or unsaturated. Examples of suitable monoalcohols are methanol, ethanol, propanol, butanol, pentanol and the hydrogenation products of the above-mentioned carboxylic acids containing 6 to 22 carbon atoms. More particularly, $R^2$ is a methyl group.

AlkO preferably stands for a $CH_2CH_2O$ group.

Alkoxylated carboxylic acid esters of formula (I), in which $R^1CO$ is a linear, even-numbered acyl group containing 8 to 18 carbon atoms, AlkO stands for a $CH_2CH_2O$ group, n has an average value of 5 to 15 and $R^2$ is a methyl group, are particularly suitable. Examples of such compounds are carboxylic acid methyl esters alkoxylated with, on average, 5, 7, 9 or 11 moles of ethylene oxide.

The alkoxylated carboxylic acid esters may be present as sole surfactant in the compositions according to the invention. However, the compositions preferably contain other anionic and/or nonionic surfactants. Anionic co-surfactants according to the present invention include aliphatic sulfates, such as fatty alcohol sulfates, fatty alcohol ether sulfates, fatty acid polyglycol ester sulfates, dialkyl ether sulfates, monoglyceride sulfates and aliphatic sulfonates, such as alkane sulfonates, olefin sulfonates, ether sulfonates, n-alkyl ether sulfonates, ester sulfonates, and lignin sulfonates. Fatty acid cyanamides, sulfosuccinic acid esters, fatty acid isethionates, acylaminoalkane sulfonates (fatty acid taurides), fatty acid sarcosinates, ether carboxylic acids and alkyl (ether) phosphates may also be used for the purposes of the invention, but are not preferred. The compositions according to the invention preferably contain fatty alcohol sulfates, fatty alcohol ether sulfates and/or fatty acid polyglycol ester sulfates as anionic surfactants.

Suitable fatty acid polyglycol ester sulfates preferably correspond to formula (II):

$$R^3COO(AO)_xSO_3X \quad \text{(II)}$$

in which $R^3CO$ is a linear or branched, saturated or unsaturated acyl group containing 6 to 22 carbon atoms, x has an average value of 1 to 3 and AO is a $CH_2CH_2O$—, $CH_2CH(CH_3)O$— and/or $CH(CH_3)CH_2O$ group and X is an alkali and/or alkaline earth metal, ammonium, alkylammonium, alkanol-ammonium or glucammonium, and are produced by sulfation of the corresponding fatty acid polyglycol esters which, in turn, are obtainable by the relevant preparative methods of organic chemistry. To this end, ethylene oxide, propylene oxide or a mixture thereof is added—in random or block distribution—onto the corresponding fatty acids in the presence of an acid as catalyst, but preferably in the presence of bases, for example sodium methylate or calcined hydrotalcite. If a degree of alkoxylation of 1 is required, the intermediate products may also be prepared by esterification of the fatty acids with a corresponding alkylene glycol. The sulfation of the fatty acid polyglycol esters may be carried out in known manner with chlorosulfonic acid or, preferably, gaseous sulfur trioxide, the molar ratio of fatty acid glycol ester to sulfating agent being in the range from 1:0.95 to 1:1.2 and preferably in the range from 1:1; to 1:1.1 and the reaction temperature being in the range from 30 to 80° C. and preferably in the range from 50 to 60° C. The fatty acid polyglycol esters may also be undersulfated, i.e. the sulfating agent may be used in far less than the quantity which would be stoichiometrically necessary for a complete reaction. If, for example, the fatty add polyglycol ester and sulfating agent are used in a molar ratio of 1:0.5 to 1:0.95, mixtures of fatty acid polyglycol ester sulfates and fatty acid polyglycol esters are obtained. In order to avoid hydrolysis, it is very important to carry out the neutralization step at a pH value in the range from 5 to 9 and preferably in the range from 7 to 8. Typical examples of suitable starting materials are the addition products of 1 to 3 moles of ethylene oxide and/or propylene oxide, but preferably the addition products of 1 mole of ethylene oxide or 1 mole of propylene oxide onto caproic acid, caprylic acid, 2-ethylhexanoic acid, capric acid, lauric acid, isotridecanoic add, myristic add, palmitic acid, palmitoleic acid, stearic acid, isostearic acid, oleic add, elaidic acid, petroselic acid, linoleic acid, linolenic add, elaeostearic acid, arachic add, gadoleic acid, behenic acid and erucic add and technical mixtures thereof, which are then sulfated and neutralized as described above. A preferred embodiment of the invention is characterized by the use of fatty acid polyglycol ester sulfates corresponding to formula (II), in which $R^3CO$ is an acyl group containing 12 to 18 carbon atoms, x has an average value of 1 or 2, AO represents a $CH_2CH_2O$ group and X is sodium or ammonium, such as for example lauric acid+1EO sulfate sodium salt, lauric acid+1EO sulfate ammonium salt, cocofatty add+1EO sulfate sodium salt, cocofatty acid+1EO sulfate ammonium salt, tallow fatty acid+I EO sulfate sodium salt, tallow fatty acid+1EO sulfate ammonium salt and mixtures thereof.

Suitable fatty alcohol sulfates correspond to formula (III):

$$R^4O—SO_3X \quad \text{(III)}$$

in which $R^4$ is a linear or branched alkyl and/or alkenyl group containing 6 to 18 carbon atoms and X is an alkali metal and/or alkaline earth metal, ammonium, alkylammonium, alkanolammonium or glucammonium. They are anionic surfactants which are preferably obtained by sulfation of native fatty alcohols ("fatty alcohol sulfates") and subsequent neutralization. Typical examples of fatty alcohol sulfates which may be used as an additional anionic surfactant component are the sodium salts of sulfation products of caproic alcohol, caprylic alcohol, capric alcohol, lauryl alcohol, myristyl alcohol, cetyl alcohol, palmitoleyl alcohol, stearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol and erucyl alcohol and technical alcohol cuts obtained by hydrogenation of native fatty acid methyl ester fractions or aldehydes from Roelen's oxosynthesis. Fatty alcohol sulfates containing 12 to 18 and more particularly 12 to 14 carbon atoms are preferably used. Typical examples are technical $C_{12/14}$ or $C_{12/18}$ coconut fatty alcohol sulfates in the form of their sodium salts.

Fatty alcohol ether sulfates are also known anionic surfactants which are industrially obtained by sulfation of relatively long-chain primary fatty alcohol ethoxylates and subsequent neutralization. They typically correspond to formula (IV):

$$R^5O—(CH_2CH_2O)_mSO_3X \quad \text{(IV)}$$

in which $R^5$ is a linear or branched alkyl and/or alkenyl group containing 6 to 18 carbon atoms, m is a number of 1 to 10 and X is an alkali metal and/or alkaline earth metal, ammonium, alkylammonium, alkanol-ammonium or glucammonium. Typical examples of alkyl ether sulfates are the sodium salts of sulfation products of the adducts of 1 to 10 and preferably 2 to 5 moles of ethylene oxide with caproic alcohol, caprylic alcohol, capric alcohol, lauryl alcohol, myristyl alcohol, cetyl alcohol, palmitoleyl alcohol, stearyl alcohol, oleyl: alcohol, elaidyl alcohol, petroselinyl alcohol, linolyl alcohol, linolenyl alcohol, elaeostearyl alcohol, arachyl alcohol, gadoleyl alcohol, behenyl alcohol and erucyl alcohol and technical alcohol cuts obtained by hydrogenation of native fatty add methyl ester fractions or aldehydes from Roelen's oxosynthesis. Fatty alcohol ether sulfates containing 12 to 18 and more particularly 12 to 14 carbon atoms and having a degree of ethoxylation of 2 to 5 are preferably used. Typical examples are technical $C_{12/14}$ or $C_{12/18}$ coconut fatty alcohol ether sulfates in the form of their sodium salts which may have a conventional or even narrow homolog distribution.

Besides the alkoxylated carboxylic acid esters and the anionic surfactants optionally present, the compositions according to the invention may additionally contain other nonionic surfactants. Other nonionic surfactants in the context of the invention include alkoxylated alcohols, such as polyglycol ethers, fatty alcohol polyglycol ethers, alkyl phenol polyglycol ethers, end-capped polyglycol ethers, mixed ethers and hydroxy mixed ethers and alkyl polyglycosides. Ethylene oxide/propylene oxide block polymers and fatty acid alkanolamides and fatty acid polyglycol esters may also be used. In one particularly preferred embodiment, the compositions according to the invention contain alkyl polyglycosides, fatty acid alkanolamides and/or alcohol ethoxylates as the other nonionic surfactants.

Alkyl and alkenyl oligoglycosides are known nonionic surfactants which correspond to formula (V):

$$R^6O—[G]_p \qquad (V)$$

in which $R^6$ is an alkyl and/or alkenyl group containing 6 to 22 carbon atoms, G is a sugar unit containing 5 or 6 carbon atoms and p is a number of 1 to 10. They may be obtained by the relevant methods of preparative organic chemistry. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (V) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl group $R^6$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl group $R^6$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut fatty alcohol with a DP of 1 to 3 are preferred.

The compositions according to the invention may contain fatty acid alkanolamides preferably corresponding to formula (VI):

$$R^7CO—\overset{\overset{R^9}{|}}{N}—R^8 \qquad (VI)$$

in which $R^7CO$ is an aliphatic acyl group containing 6 to 22 carbon atoms, $R^8$ is a hydroxyalkyl group containing 2 to 4 carbon atoms and $R^9$ is hydrogen or has the same meaning as $R^8$. These fatty acid alkanolamides are also known additives which are normally obtained by condensation of fatty acids with alkanolamines. Typical examples are condensation products of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid or erucic acid and technical mixtures thereof with monoethanolamine or diethanolamine. Fatty acid alkanolamides corresponding to formula (VI), in which $R^7CO$ is a $C_{12-18}$ acyl group, $R^8$ is a hydroxyethyl group and $R^9$ has the same meaning as $R^8$ or is hydrogen, are preferably used. It is particularly preferred to use $C_{12/14}$ or $C_{12/18}$ coconut fatty acid mono- or diethanolamide.

Finally, another group of nonionic surfactants which may be used are alcohol ethoxylates preferably corresponding to formula (VII):

$$R^{10}O—(CH_2CH_2O)_zH \qquad (VII)$$

in which $R^{10}$ is a linear or branched alkyl and/or alkenyl group containing 12 to 18 carbon atoms and z is a number of 1 to 50 and preferably 5 to 30. These alcohol ethoxylates are also known industrial products which are normally obtained by base-catalyzed addition of ethylene oxide onto primary alcohols. Depending on the catalysts used (for example sodium methylate or calcined hydrotalcite), the ethoxylates may have a conventional or narrow homolog distribution. The alcohol ethoxylates may be adducts of 1 to 50 moles of ethylene oxide with fatty alcohols ("fatty alcohol ethoxylates") or oxoalcohols ("oxo alcohol ethoxylates"). Typical examples are the ethoxylates of caproic alcohol, caprylic alcohol, 2-ethyl hexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol, erucyl alcohol and brassidyl alcohol and the technical mixtures thereof obtained, for example, in the high-pressure hydrogenation of technical methyl esters based on fats and oils or aldehydes from Roelen's oxo synthesis and as monomer fraction in the dimerization of unsaturated fatty alcohols. Adducts of 1 to 50, preferably 5 to 30 and more preferably 10 to 20 moles of ethylene oxide with technical fatty alcohols containing 12 to 18 carbon atoms, for example coconut, palm, palm kernel or tallow fatty alcohol, are preferred.

In one preferred embodiment of the invention, the alkoxylated carboxylic acid esters corresponding to formula (I) are not used on their own, but rather in admixture with one or more of the above-mentioned anionic and/or nonionic surfactants, i.e. in the form of detergent mixtures. The detergent mixtures preferably contain (a) 1 to 90, preferably 5 to 80% by weight of alkoxylated carboxylic acid esters, (b) 0 to 25, preferably 1 to 15% by weight of fatty acid polyglycol ester sulfates, (c) 0 to 50, preferably 1 to 45% by weight of alkyl sulfates and/or alkyl ether sulfates, (d) 0 to 50, preferably 1 to 30% by weight of alkyl and/or alkenyl oligoglycosides, (e) 0 to 15, preferably 1 to 5% by weight of fatty acid alkanolamides and (f) 0 to 30, preferably 1 to 20% by weight of alcohol ethoxylates, with the proviso that the quantities add up to 100% by weight, based on the detergent mixture.

The compositions according to the invention contain the alkoxylated carboxylic acid esters either as sole surfactant or in admixture with the described other surfactants, preferably in the described detergent mixture, in quantities of 1 to 65% by weight and preferably in quantities of 3 to 40% by weight.

Besides the alkoxylated carboxylic acid esters already described and optionally other anionic and/or nonionic surfactants, the gel-form compositions according to the invention additionally contain thickeners.

The compositions according to the invention are preferably pseudoplastic and have a yield point, i.e. in the absence of external forces (at rest), the compositions hardly flow and behave like a solid whereas, when pressure is applied (external forces), the compositions become flowable and can readily be introduced into their basket-like containers. The compositions preferably have a viscosity in the range from 30,000 to 150,000 mPas, as measured with a Brookfield RVT rotational viscosimeter with Helipath and spindle TA, at 1 r.p.m./23° C.

A polysaccharide or mixtures of various polysaccharides, preferably xanthan gum and/or guar gum, is/are preferably used as thickener for the preferred pseudoplastic gel-form cleaning compositions. Xanthan is formed from a chain containing β-1,4glucose (cellulose) with side chains. The structure of the subgroups consists of glucose, mannose, glucuronic acid, acetate and pyruvate. Xanthan is produced by Xanthomonas campestris under aerobic conditions with a molecular weight of $2–15\times10^6$. Xanthan is prepared inter alia in batch cultures and, after the culture has been killed off, followed by precipitation with propanol, is dried and ground. Other suitable processes are also described in the literature.

The polysaccharides are present in quantities of preferably 1.0 to 5.0% by weight and more preferably 1.5 to 4% by weight.

Instead of the preferred polysaccharides, polyacrylates or cationic polymers, such as Polygel K 100® of 3 V Sigma S. P. A., may be present as thickeners. Suitable polyacrylates are those with molecular weights in the range from 750,000 to 2,500,000 and preferably in the range from 1,000,000 to 1,500,000. Preferred polyacrylates are homopolymers of acrylic acid which may be present in either acidic or neutralized form. Polyacrylates which have been polymerized in a mixture of ethyl acetate and cyclohexane are particularly preferred. If desired, the polyacrylates 10 may be crosslinked, for example with the allyl ethers of pentaerythritol, sucrose or propylene glycol. If the polyacrylates are present in their acid form, the acid value is preferably in the range from 700 to 750. The polyacrylates in this form are white powders which generally have a particle size of on average 2 to 6 $\mu$. In the crosslinked products, the acrylic acid content is preferably between 65 and 68%. A particularly suitable representative of such polyacrylates is Carbopol 981® of G. F. Goodrich which has an average molecular weight of 1,250,000. The polyacrylates are used in quantities of preferably 0.1 to 10% by weight, more preferably 1 to 5% by weight and most preferably 2 to 4% by weight, based on the composition.

The cationic polymers, preferably Polygel K 100® are present in quantities of preferably 1.0 to 10% by weight and more preferably 1.5 to 6% by weight, based on the composition.

If normally thickened gel-form compositions rather than pseudoplastic compositions are required or if the pseudoplastic compositions are to be modified in their viscosity behavior, typical thickeners, for example urea, sodium chloride, sodium sulfate, magnesium sulfate, ammonium chloride and magnesium chloride and combinations thereof, may be present in the compositions according to the invention instead of or in addition to the polysaccharides.

In addition to the alkoxylated carboxylic acid esters already described and optionally other anionic and/or nonionic surfactants and the thickeners, the gel-form cleaning compositions according to the invention may also contain lime-dissolving agents, builders, perfumes, solvents, perfume solubilizers, pH regulators, preservatives, dyes and germ inhibitors.

Preferred lime-dissolving agents are lime-dissolving acids, such as citric acid, formic acid, acetic acid, lactic acid or water-soluble salts thereof, which are preferably used in a quantity of 1 to 12% by weight and more preferably in a quantity of 2 to 7% by weight in the cleaning compositions according to the invention.

The preferably water-soluble dyes are present either to color the composition or to color the liquid which flushes the bowl. The content of water-soluble dyes is preferably less than 1% by weight and is intended to improve the appearance of the product. If an additional color signal is required during the flushing process, the content of water-soluble dyes may be as much as 5% by weight.

The hygienic effect may be enhanced by addition of germ inhibitors. Suitable germ inhibitors are, in particular, isothiazoline mixtures, sodium benzoate and/or salicylic acid. The quantity in which these germ inhibitors are used depends to a large extent on the effectiveness of the particular compound and may be as much as 5% by weight. The germ inhibitors are preferably present in quantities of 0.01% by weight to 3% by weight.

Examples of suitable solvents in the cleaning compositions according to the invention, more especially for dyes and perfume oils, are alkanolamines, polyols, such as ethylene glycol, propylene glycol, 1,2-glycerol and other monohydric and polyhydric alcohols, and alkyl benzenesulfonates containing 1 to 3 carbon atoms in the alkyl group. The group of lower alcohols, especially ethanol, is particularly preferred. The solvent content is determined by the type and quantity of constituents to be dissolved and is generally between 0 and 5% by weight and preferably between 0.01 and 4% by weight.

The compositions according to the invention may contain as perfume solubilizers polyol fatty acid esters, for example glycerol alkoxylated with 7 moles of ethylene oxide and esterified with coconut fatty acid (Cetiol HE®, Henkel KGaA) and/or hydrogenated castor oil alkoxylated with 40 or 60 moles of ethylene oxide (Eumulgin HRE 40 or 60®, Henkel KGaA) and/or 2-hydroxyfatty alcohol ethoxylates (Eumulgin L®, Henkel KGaA). The quantity of perfume solubilizers in the compositions according to the invention is generally between 0 and 10% by weight and preferably between 1 and 7% by weight.

Other optional ingredients of the cleaning compositions according to the invention are builders, water-soluble builders being preferred by virtue of their generally lesser tendency to form insoluble residues on hard surfaces. Typical builders which may be present in accordance with the present invention are low molecular weight polycarboxylic acids and salts thereof, homopolymeric and copolymeric polycarboxylic acids and salts thereof, citric acid and salts thereof, carbonates, phosphates and silicates. Water-insoluble builders include zeolites which may also be used and mixtures of the above-mentioned builders. The group of citrates is particularly preferred. The builders may be present in the cleaning compositions according to the invention in quantities of 0 to 5% by weight.

The perfumes optionally present are known from the prior art. The dose size is determined by the required intensity of the perfume and is in the range from 0 to 15% by weight and preferably in the range from 2 to 12% by weight. In addition, standard preservatives may be present in the usual quantities of 0 to 1% by weight.

If the compositions according to the invention contain the polyacrylates as thickener, it has proved to be of advantage for achieving an optimal thickening effect to establish a pH above 6, preferably between 6 and 8 and more preferably between 6.5 and 7.5 in the compositions according to the invention. The pH value can be established solely through the composition selected for the gel-form cleaners or is adjusted by the additional incorporation of pH regulators. Suitable pH regulators are agents showing an alkaline reaction, for example water-soluble amines, such as triethanolamine or water-soluble hydroxides, such as sodium hydroxide, which are preferably used in the form of aqueous solutions.

The balance of the gel-form cleaners to 100% by weight is water.

The gel-form, preferably pseudoplastic cleaning compositions containing polysaccharides as thickeners may be produced by the process according to the already cited German patent DE-C-197 15 872. In this process, water is introduced into a commercially available mixer, for example of the Beco-Mix type, and the dye is stirred in. The polysaccharide used, preferably xanthan gum, is separately suspended with solvent, preferably ethanol, and the desired perfume oil. The resulting suspension is then introduced into the mixer at low speed, for example 30 r.p.m. It was found in tests that a time of a few minutes to a few hours after all the components have been added is desirable for achieving the consistency. In the present case, the alkoxylated carboxylic acid ester was slowly added after 30 minutes, optionally in admixture with the other surfactants. The other components are then added.

In another variant of the production of the compositions according to the invention containing polysaccharides as thickeners, the lime-dissolving agents, preferably citric acid, are initially introduced together with the calculated quantity of water and polysaccharides, preferably xanthan gum, are scattered in with stirring. After swelling of the thickener, preferably after ca. 30 minutes, a second preparation of the alkoxylated carboxylic acid esters and optionally other surfactants, optionally perfume oil, optionally dyes and optionally other auxiliaries is stirred in. If a bubble-free gel is to be guaranteed, the already described mixture should be placed under reduced pressure or under vacuum in a suitable container generally for a short time, for example 15 minutes, depending on the viscosity.

To produce the compositions according to the invention containing polyacrylates, preferably Carbopol 981®, as thickener, it is of advantage to prepare a dispersion of polyacrylates with average molecular weights of 750,000 to 2,500,000, alkoxylated carboxylic acid esters corresponding to formula (I) and optionally other ingredients in water and to adjust a pH above 6. The pH should advantageously only be adjusted when all the ingredients of the composition according to the invention are dispersed in water because the final viscosity is reached after pH adjustment. The polyacrylate-containing compositions are preferably produced by stirring the alkoxylated carboxylic acid esters corresponding to formula (I) and optionally other surfactants and optionally other ingredients into water and any solubilizers present, then adding, the polyacrylates and finally adjusting the pH value.

The compositions according to the invention containing the cationic polymers as thickeners may be produced in the same way as the polyacrylate-containing compositions except that there is no need for pH adjustment to values above 6.

If pseudoplastic gel-form cleaning compositions are not required, the compositions may be produced simply by stirring the constituents and then adding the thickeners.

The gel-form toilet cleaners according to the invention are formed and may be placed in suitable containers, such as small baskets or the like. They are stable in storage, show good cleaning performance, exhibit excellent initial foaming behavior and may be refilled as required. In addition, the compositions according to the invention are clear in appearance, i.e. no clouding occurs even after prolonged storage. Finally, relatively large quantities of perfumes may also be incorporated in the compositions without difficulty.

The present invention also relates to the use of alkoxylated carboxylic acid esters corresponding to formula (I), optionally in admixture with other anionic and/or nonionic surfactants, as surfactant for the production of gel-form cleaning compositions for flush toilets.

EXAMPLES

General Production Procedure for Compositions Containing Xanthan Gum (Polysaccharides)—cf. DE-C-197 15 872

General Production Procedure for Compositions Containing Polyacrylates (Carbopol 981®):

The calculated quantity of water was initially introduced and all the ingredients of the composition (surfactant, perfume and ethanol) were added in the quantities shown in Table 1 and stirred in. The quantity of polyacrylate (Carbopol 981®) shown in Table 1 was then added and stirred in under moderate conditions. After all the ingredients had been thoroughly dispersed, an aqueous sodium hydroxide solution was added until a pH of 6.5 to 7.5 had been reached. Clear gel-form products were obtained.

General Production Procedure for Compositions Containing Cationic Polymers (Polygel K 100®):

The calculated quantity of water was initially introduced and all the ingredients of the composition (surfactant, perfume and ethanol) were added in the quantities shown in Table 1 and stirred in. The quantity of cationic polymer shown in Table 1 was then added and stirred in under moderate conditions. After all the ingredients had been thoroughly dispersed, the quantity of citric acid shown in Table 1 was stirred in. Gel-form products were obtained. The composition had a pH of 2.5.

TABLE 1

| | (figures = % active substance) | | | | | | | |
|---|---|---|---|---|---|---|---|---|
| | 1 | 2 | 3 | 4 | 5 | 6 | 7 | 8 |
| FMEO $C_{12/18}$ 10 EO[1] | 10 | 10 | 10 | 10 | 10 | 10 | 10 | 10 |
| Xanthan gum | 2 | 4 | | | 2 | 4 | | |
| Polygel K 100 ® | | | 3 | | | | | |
| Carbopol 981 ® | | | | 3 | | | 3 | 3 |
| Citric acid | 3 | 3 | 1 | 0 | 3 | 3 | | |
| $C_{8/10}$ alkyl polyglucoside[2] | 5 | 0 | 5 | 5 | 5 | 0 | 3 | 3 |
| $C_{12/14}$ 2E0 sulfate Na salt[3] | 0 | 0 | 0 | 0 | | | 3 | |
| Perfume | 5 | 5 | 5 | 5 | 5 | 5 | 5 | 5 |
| $C_{12/14}$ alkyl sulfate Na salt[4] | 0 | 0 | 0 | 0 | | | | 3 |
| NaOH pH adjust to 6.5–7.5 | No | No | No | Yes | No | No | Yes | Yes |
| Water | to 100 | to 100 | to 100 | to 100 | to 100 | to 100 | to 100 | to 100 |

[1]methyl ester of a $C_{12/18}$ fatty acid ethoxylated with 10 moles ethylene oxide (EO)
[2]alkyl polyglucoside containing 8 and 10 carbon atoms in the alkyl group; DP = 1.6
[3]sodium salt of a $C_{12/14}$ alcohol sulfate ethoxylated with 2 moles EO
[4]sodium salt of a $C_{12/14}$ alcohol sulfate

What is claimed is:

1. A gel composition comprising a polysaccharide thickener and from 3 to 40% of a surfactant component, the surfactant component comprising an alkoxylated carboxylic acid ester corresponding to general formula (I):

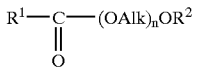

(I)

wherein $R^1C(O)$ represents an aliphatic acyl group, each AlkO independently represents an alkoxylate selected from the group consisting of $CH_2CH_2O$, $CHCH_3CH_2O$ and $CH_2CHCH_3O$, n is a number of from 1 to 20, and $R^2$ represents an aliphatic alkyl group.

2. The gel composition according to claim 1, wherein $R^1C(O)$ represents an aliphatic acyl group having from 8 to 18 carbon atoms, each AlkO represents a $CH_2CH_2O$, $R^2$ represents a methyl group, and n is a number of from 5 to 15.

3. The gel composition according to claim 1, wherein the alkoxylated carboxylic acid ester is prepared by reacting a carboxylic acid and an alkylene oxide in the presence of calcined hydrotalcite.

4. The gel composition according to claim 1, wherein the surfactant component is present in an amount of from 1% to 65% by weight, based on the gel composition.

5. The gel composition according to claim 1, wherein the surfactant component further comprises one or more additional surfactants selected from the group consisting of fatty acid polyglycol ester sulfates, alkyl sulfates, alkyl ether sulfates, alk(en)yl oligoglycosides, fatty acid alkanolamides, alcohol ethoxylates and mixtures thereof.

6. The gel composition according to claim 1, wherein the surfactant component comprises from 5% to 80% by weight of the alkoxylated carboxylic acid ester, and further comprises from 1% to 15% by weight of a fatty acid polyglycol ester sulfate, from 1% to 45% by weight of an alkyl (ether) sulfate, from 1% to 30% by weight of an alk(en)yl oligoglycoside, from 1% to 5% by weight of a fatty acid alkanolamide, from 1% to 20% by weight of an alcohol ethoxylate, all weights based on the surfactant component.

7. The gel composition according to claim 1, wherein the thickener comprises a polysaccharide.

8. The gel composition according to claim 7, wherein the polysaccharide is selected from the group consisting of xanthan gum, guar gum, and mixtures thereof.

9. The gel composition according to claim 1, wherein the thickener comprises xanthan gum.

10. The gel composition according to claim 1, wherein the composition has a viscosity of from 30,000 to 150,000 mPas.

11. A gel composition comprising a polysaccharide thickener and from 3 to 40% of a surfactant component, the surfactant component comprising (i) an alkoxylated carboxylic acid ester corresponding to general formula (I):

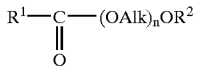

(I)

wherein $R^1C(O)$ represents an aliphatic acyl group having from 8 to 18 carbon atoms, each AlkO represents a $CH_2CH_2O$ group, n is a number of from 5 to 15, and $R^2$ represents a methyl group; and (ii) one or more additional surfactants selected from the group consisting of fatty acid polyglycol ester sulfates, alkyl sulfates, alkyl ether sulfates, alk(en)yl oligoglycosides, fatty acid alkanolamides, alcohol ethoxylates and mixtures thereof; wherein the composition has a viscosity of from 30,000 to 150,000 mPas.

12. A method of providing controlled release of a cleaning agent to a toilet, said method comprising:

(a) providing a gel composition comprising a thickener and a surfactant component, the surfactant component comprising an alkoxylated carboxylic acid ester corresponding to general formula (I):

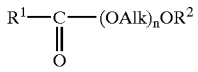

(I)

wherein $R^1C(O)$ represents an aliphatic acyl group, each AlkO independently represents an alkoxylate selected from the group consisting of $CH_2CH_2O$, $CHCH_3CH_2O$ and $CH_2CHCH_3O$, n is a number of from 1 to 20, and $R^2$ represents an aliphatic alkyl group; and (b) placing the gel composition in a toilet such that when the toilet is flushed, flushing water contacts the gel composition.

13. The method according to claim 12, wherein the gel composition is provided in a container having at least one opening providing for fluid connection between an interior area of the container and an exterior area of the container, and the container is placed in the toilet such that the flushing water contacts the gel composition through the at least one opening.

14. The method according to claim 12, wherein the toilet comprises a container having at least one opening providing for fluid connection between an interior area of the container and an exterior area of the container, the container positioned in the toilet such that the flushing water contacts the at least one opening, and the gel composition is placed in the container.

15. The method according to claim 12, wherein $R^1C(O)$ represents an aliphatic acyl group having from 8 to 18 carbon atoms, each AlkO represents a $CH_2CH_2O$, $R^2$ represents a methyl group, and n is a number of from 5 to 15.

16. The method according to claim 12, wherein the alkoxylated carboxylic acid ester is prepared by reacting a carboxylic acid and an alkylene oxide in the presence of calcined hydrotalcite.

17. The method according to claim 12, wherein the surfactant component is present in an amount of from 1% to 65% by weight, based on the gel composition.

18. The method according to claim 12, wherein the surfactant component is present in an amount of from 3% to 40% by weight, based on the gel composition.

19. The method according to claim 12, wherein the surfactant component further comprises one or more additional surfactants selected from the group consisting of fatty acid polyglycol ester sulfates, alkyl sulfates, alkyl ether sulfates, alk(en)yl oligoglycosides, fatty acid alkanolamides, alcohol ethoxylates and mixtures thereof.

20. The method according to claim 12, wherein the surfactant component comprises from 5% to 80% by weight of the alkoxylated carboxylic acid ester, and further comprises from 1% to 15% by weight of a fatty acid polyglycol ester sulfate, from 1% to 45% by weight of an alkyl (ether) sulfate, from 1% to 30% by weight of an alk(en)yl oligoglycoside, from 1% to 5% by weight of a fatty acid alkanolamide, from 1% to 20% by weight of an alcohol ethoxylate, all weights based on the surfactant component.

21. The method according to claim 12, wherein the thickener comprises a polysaccharide.

22. The method according to claim 12, wherein the polysaccharide is selected from the group consisting of xanthan gum, guar gum, and mixtures thereof.

23. The method according to claim 12, wherein the thickener comprises xanthan gum.

24. The method according to claim 12, wherein the composition has a viscosity o from 30,000 to 150,000 mPas.

25. A product for dispensing a cleaning agent in a toilet, said product comprising:

(a) a gel composition which comprises a thickener and a surfactant component, the surfactant component comprising an alkoxylated carboxylic acid ester corresponding to general formula (I):

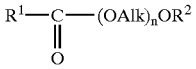

(I)

wherein $R^1C(O)$ represents an aliphatic acyl group, each AlkO independently represents an alkoxylate selected from the group consisting of $CH_2CH_2O$, $CHCH_3CH_2O$ and $CH_2CHCH_3O$, n is a number of from 1 to 20, and $R^2$ represents an aliphatic alkyl group; and (b) a container having at least one opening providing for fluid connection between an interior area of the container and an exterior area of the container;

wherein the gel composition is disposed in the interior area of the container.

* * * * *